US008882931B2

(12) United States Patent
Fritz et al.

(10) Patent No.: US 8,882,931 B2
(45) Date of Patent: Nov. 11, 2014

(54) WATER-CONDUCTING HOUSEHOLD APPLIANCE

(75) Inventors: Heiko Fritz, Herbrechtingen (DE); Martin Gula, Badejov (SK); Jan Ondrejcak, Kosice (SK); Michael Georg Rosenbauer, Reimlingen (DE); Bernd Schwenk, Lauingen (DE); Daniel Zvada, München (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 239 days.

(21) Appl. No.: 13/368,373

(22) Filed: Feb. 8, 2012

(65) Prior Publication Data

US 2012/0199169 A1 Aug. 9, 2012

(30) Foreign Application Priority Data

Feb. 9, 2011 (DE) ..... 10 2011 003 858

(51) Int. Cl.
*B08B 3/00* (2006.01)
*A47L 15/42* (2006.01)

(52) U.S. Cl.
CPC ..... *A47L 15/4255* (2013.01)
USPC ..... 134/56 D; 134/57 D

(58) Field of Classification Search
CPC combination set(s) only.
See application file for complete search history.

(56) References Cited

U.S. PATENT DOCUMENTS

| | | | | |
|---|---|---|---|---|
| 3,436,042 | A * | 4/1969 | Van Goubergen | 248/636 |
| 5,503,172 | A * | 4/1996 | Hedeen et al. | 134/183 |
| 2004/0084068 | A1 * | 5/2004 | Hur et al. | 134/58 D |

* cited by examiner

*Primary Examiner* — Jason Ko
(74) *Attorney, Agent, or Firm* — James E. Howard; Andre Pallapies

(57) ABSTRACT

A water-conducting household machine, specifically a dishwasher, includes a compartment having a closable compartment opening, and at least one washing device for generating at least one water jet in the compartment. At least one baffle plate is disposed on an inner side of the compartment in at least one area of impact of the water jet and in such a way as to be vibration-free for noise reduction, particularly for noise damping and/or sound insulation.

15 Claims, 1 Drawing Sheet

WATER-CONDUCTING HOUSEHOLD APPLIANCE

BACKGROUND OF THE INVENTION

The invention relates to a water-conducting household appliance, specifically a dishwasher, with a compartment that has a closable compartment opening, and with at least one washing device for generating at least one water jet within the compartment, as well as with at least one noise-damping means.

Water-conducting household appliances of the type mentioned in the introduction are known from the prior art. They comprise a compartment with a closable compartment opening through which items to be washed can be introduced into the interior of the compartment. For example, one or more water jets can be generated within the compartment by means of a washing device, and specifically by means of at least one spray arm of the washing device disposed rotatably in the compartment and enabling the items to be washed to be cleaned. As a result of its normally cubic external dimensions and lightweight structure, the compartment acts as a large resonance chamber that can be stimulated by sprays or jets of water striking its surface.

In the past few years there has been a trend towards designing kitchens as living areas. As a result, the acoustic requirements, in particular for water-conducting household appliances have changed. The practice of providing noise-damping means in order to meet these requirements is known. Moving parts such as circulation pumps, discharge pumps and valves produce noises that are transmitted through the air. Sound insulation is normally achieved by attaching bitumen matting to the exterior of the compartment, which is normally made of stainless steel. In addition, or independently thereof, noise-absorbing or noise-damping materials that absorb airborne sound energy and transform it into heat can be provided on the exterior of the compartment. Known water-conducting household appliances normally have flat, prefabricated matting made of cotton fiber combined with phenolic resin built in for this purpose. Polyester materials are also sometimes used as a means of sound insulation. The known means of sound insulation and/or noise damping are normally laid around the outside of the compartment, filling the area between the outer walls of the household appliance in question and the compartment. To reduce the vibration amplitudes of the metal parts, and in particular of the stainless steel compartment, polymer-modified bitumen matting with an adjusted loss factor is glued to the metal surfaces, normally with a hot-melt adhesive. The use of self-adhesive bitumen matting is also known. The insulating and/or sound/damping layers defined above are intended not only to reduce stimulation of vibration but also to have an anti-drumming effect on the metal parts.

However, a reduction in sound power radiation such as that described above is only possible to a limited extent. This is partly due to increases in volume of dishwasher compartments which, given that standard external measurements of water-conducting household appliances have remained the same, results in less installation space being available for sound insulation and/or noise damping. In addition, the energy consumption of modern water-conducting household appliances has been optimized due to sharply rising energy prices. Bitumen matting applied with adhesive has high thermal capacity and thus causes a certain amount of heat loss.

This means that a compromise always has to be made between heat loss and sound insulation and/or noise damping.

BRIEF SUMMARY OF THE INVENTION

It is thus an object of the invention to provide a water-conducting household appliance with sufficient noise damping.

The object of the invention is achieved in full by the features contained in claim 1. It has the advantage that, instead of the secondary means of sound insulation and/or noise damping provided previously, in particular on the outside of the compartment, a primary means of sound insulation and/or noise damping is provided, and in particular on the inside of the compartment, which prevents the compartment from being stimulated to vibrate by water jets or water spray. According to the invention, as a means of noise reduction, and particularly as a means of noise damping and/or sound insulation, at least one baffle plate is disposed on an inner side of the compartment in at least one area of impact of the water jet and in such a way as to be vibration-free. The baffle plate is therefore disposed in front of the inner wall of the compartment in question and in an area in which the water jet would normally strike the inner wall of the compartment. As a result, in the area of the baffle plate, the water jet does not strike the compartment but the baffle plate, which is disposed on the compartment in such a way as to be vibration-free, so that the vibrations caused in the baffle plate are not transferred to the compartment.

The baffle plate is preferably disposed in an area that is critical to the stimulation of the vibration of the compartment. Particularly preferably, the baffle plate is configured so as to extend over the entire area of impact of the water jet on the inside of the compartment. It is therefore conceivable, for example, for a circular baffle plate to be provided on the roof of the compartment.

According to a further advantageous configuration of the invention, the baffle plate is made of a material with higher damping properties than the compartment, such as glass or plastic. This alone prevents, or at least hinders, stimulation of the baffle plate. The baffle plate is preferably configured—and disposed on the compartment—in such a way that it is self-cleaning and no deposits of dirt are able to accumulate. Provision of the baffle plate on the inside of the compartment means that sound insulation and/or noise-damping means such as, in particular, the insulating matting described in the introduction, in particular bitumen matting or similar, can be either dispensed with or made smaller in size, with the result that energy loss, in particular, can be reduced and the household appliance's energy consumption improved.

The baffle plate preferably has a sound-insulating and/or noise-damping surface structure, a ribbed structure being particularly preferable. The ribbed structure also ensures that the water jet does not strike the baffle plate all over, but only according to the number, size, arrangement and configuration of the ribs and at an angle of less than 90°. This ensures that the baffle plate is struck softly and that stimulation of vibration is prevented or at least reduced.

The baffle plate is preferably fastened to the inside of the compartment using a spring damper system. The spring damper system actively prevents, or at least reduces, the transfer of vibration from the baffle plate to the compartment.

Particularly preferably, the spring damper system comprises at least one intermediate piece made of a vibration-decoupling and/or vibration-damping material. The intermediate piece can therefore be an elastically moldable connecting piece that is suitably self-damping. Provision of such an intermediate piece for the spring damper system reduces the system's susceptibility to faults, in particular, in addition to ensuring, in a simple manner, that it is configured to be self-cleanable. Expediently, the materials of the baffle plate and/or the intermediate piece are selected to be resistant to the cleaning agents and/or detergents used in the household appliance.

According to a further advantageous configuration, the baffle plate is disposed on a side wall and/or on the roof and/or the floor of the compartment. Particularly if the baffle plate is disposed on a side wall, a transverse baffle is required by means of which the water jet that is actually striking the side wall is redirected, particularly in the direction of the roof of the compartment. Expediently, the baffle plate on the side wall extends along the entire width of said side wall. In this context, side wall refers to both the two side walls of the compartment and the rear wall, but also to the side wall formed by the door that closes the compartment. If the baffle plate is disposed on the roof of the compartment it preferably extends essentially over the entire surface of the roof.

It is particularly preferable for at least one and preferably several baffle plates as described above to be disposed and/or configured on the side walls and/or on the roof and/or on the floor of the compartment, that is to say for baffle plates to be provided everywhere where a water jet, particularly of the washing device, would strike the compartment wall, either directly or indirectly (as a result of being redirected).

Various other advantageous configurations of the invention are described in the subclaims.

BRIEF DESCRIPTION OF THE DRAWINGS

The invention and the various advantageous configurations thereof are described in more detail below with the aid of diagrammatic drawings (FIGS. 1 and 2), wherein.

DETAILED DESCRIPTION OF EXEMPLARY EMBODIMENTS OF THE PRESENT INVENTION

Figure 1:
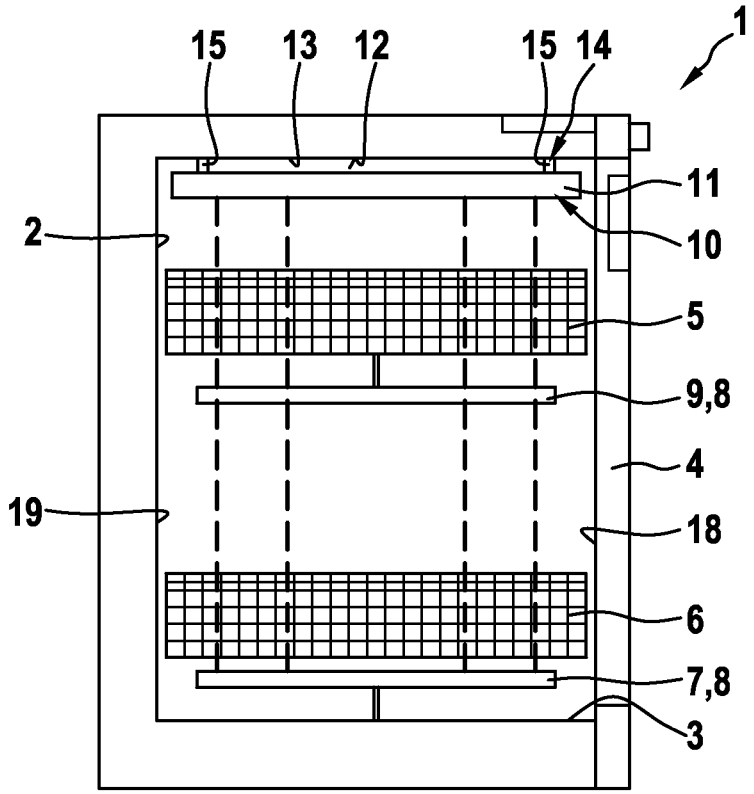
FIG. 1 shows a simplified representation of a first advantageous exemplary embodiment of a water-conducting household appliance.

FIG. 1 shows a simplified representation of a water-conducting household appliance which is configured as a dishwasher and has a compartment 2 that is made of stainless steel in the present exemplary embodiment and has a compartment opening 3 on one side that can be closed by a door 4 of the household appliance. The compartment 2 contains two baskets 5 and 6, disposed one above the other, which serve to receive items to be washed and can be pulled out of the compartment 2 through the compartment opening 3, in particular by means of a system of rails. A first spray arm 7 of a spray device 8 is disposed underneath the lower basket 6. When the water-conducting household appliance is in operation the spray arm 7 is set in rotational motion in a known manner by the water jets it emits—shown here by dotted lines. A second spray arm 9 of the spray device 8 is disposed above the lower basket 6 close to the underside of the upper basket 5. The spray arm 9 has the same function as the spray arm 7, so needs no further description here.

The water-conducting household appliance further comprises a sound insulation and/or noise-damping means 10 that is embodied as a baffle plate 11 in the present exemplary embodiment and is disposed on the inside 12 of the roof 13 of the compartment 2 in such a way as to be vibration-free. The baffle plate 11 extends essentially over the entire surface of the roof 13. For the purpose of vibration decoupling a spring damper system 14 is provided, by means of which the baffle plate 11 is disposed on the inside 12 of the roof 13. The spring damper system 14 has several intermediate pieces 15, disposed between the baffle plate and the roof 13, by means of which the baffle plate 11 is held on the roof 13. The intermediate pieces 15 are made of a vibration-decoupling and/or vibration-damping material. In the present exemplary embodiment, four of the intermediate pieces 15 are provided, with one intermediate piece 15 being disposed in a corner area either of the baffle plate 11 or of the roof 13. It is of course possible for more or fewer intermediate pieces to be provided. The fact that the baffle plate 11 disposed on the roof is configured in such a way that it extends essentially over the entire roof 13 results in its being is disposed in an area struck by water jets and/or washing liquor emitted by the spray arms 7 and/or 9 (washing liquor refers to water mixed with other substances, in particular detergents, rinse aids, additives such as softeners, etc. and dirt particles). The water jets therefore strike the baffle plate which, as a result of the intermediate pieces 15, is disposed on the roof 13 in such a way as to be vibration-free, so the impulses affecting the baffle plate 11, as well as any vibration caused by the water jets as a result, are not transferred to the compartment 2. At the very least, any transfer of vibration to the compartment is considerably reduced.

The water-conducting household appliance thus has primary sound insulation and/or noise damping, in particular inside the compartment, that prevents the compartment 2 from being stimulated to vibrate. As a result, a particularly quiet water-conducting household appliance is provided of which the use in kitchens that form part of living areas is unproblematic. In addition, the secondary sound insulation and/or noise-damping means normally provided, particularly on the outside of compartments, such as bitumen matting, can be dispensed with or at least reduced in quantity and size, so that the compartment 2 can be configured to be larger, including when the external measurements of the water-conducting household appliance remain the same. As a result, the energy efficiency of the water-conducting household appliance is also improved, as the heat loss caused by the sound insulation and/or noise damping means used previously is reduced.

Figure 2:
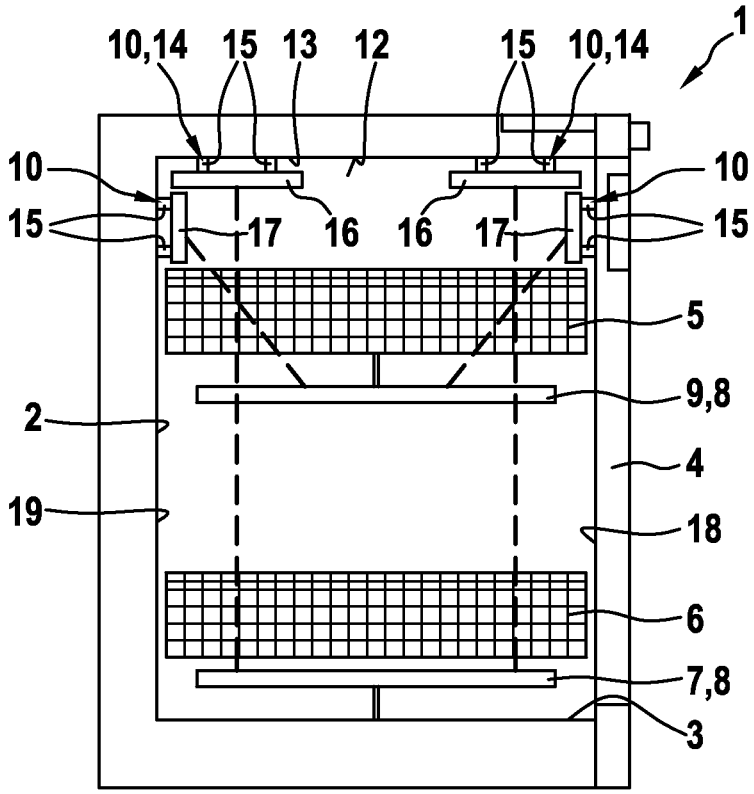
FIG. 2 shows a simplified representation of a second advantageous exemplary embodiment of the water-conducting household appliance.

FIG. 2 shows a simplified representation of a second exemplary embodiment of a water-conducting household appliance. Elements already known from FIG. 1 are given the same reference numbers, which thus refer to the same elements as in FIG. 1. Therefore, only details of the differences between the two embodiments are given below.

Unlike in the previous exemplary embodiment, the water-conducting household appliance as shown in the second exemplary embodiment has several noise reduction means 10, in particular noise damping and/or sound insulation means. Thus, the one baffle plate 11 disposed on the roof 13 is replaced by several smaller baffle plates 16, each of which is disposed, via several intermediate pieces 15, on the roof 13 or the inside 14 of the compartment 2, in the area in which the water jets 7 and/or 9 are disposed.

In the event that the spray arms of the water-conducting household appliance are configured in such a way that the water jets not only spray vertically upwards but, alternatively or in addition, spray diagonally, for example at an angle of 45°—as indicated by the dotted lines running diagonally from the spray are—according to the second exemplary embodiment, further baffle plates 17 are provided, preferably on two opposing side walls 18 and 19 of the compartment 2, with the side wall 19 being formed by the rear wall of the compartment 2 and the side wall 18 by the inside of the door 4. The baffle plates 17 are also disposed on, or fastened to, either side wall 18 or side wall 19, in each case by means of several of the intermediate pieces 15 described above. They are located in the area struck by the diagonally directed water jets of the spray arm 9, thus reducing or preventing the stimulation of vibration of compartment 2 when water jets are diagonal, it being possible for the baffle plates 17 to also serve as redirecting baffles that redirect the diagonal water jet in the direction of the roof 13. Preferably, the baffle plates 17 and 16 are disposed, and the spray arm 9 configured, in such a way that the water jet redirected by the baffle plates 17 strikes the baffle plates 16 in each case.

This results in the water-conducting household appliance being provided with particularly effective overall noise reduction, and in particular sound insulation and/or noise damping. Baffle plates can of course also be provided on the side walls, in the area of the lower spray arm 7. Particularly preferably, corresponding baffles plates 17 are also disposed on the remaining two side walls of the compartment 2 that are not shown in the figures. The baffle plates 17 preferably also extend essentially over the entire width of the side wall in question.

In the present exemplary embodiment, the baffle plates 11 and 16 and/or 17 are made of a material with high damping properties, such as glass or plastic, so that at least stimulation of vibration of baffle plates 11, 16 and 17 is reduced or prevented. To increase these damping properties, the baffle plates 11, 16 and/or 17 also have a sound-insulating or sound-damping surface structure, particularly a ribbed structure that has a self-insulating and/or damping influence on the vibration behavior of the baffle plate in question.

It can of course be expedient if at least one baffle plate is disposed in a similar manner, so as to be vibration-free, on the upper side of the floor, that is on the side of the floor that faces the interior of the washing compartment, specifically on the well on the floor of the washing compartment. This allows the kinetic impulses of the drops of liquid falling from the baskets or the crockery they hold, from the spray devices or from the roof, to be absorbed and a reduction in noise compared to that emitted by a dishwasher without baffle plates to be achieved.

What is claimed is:

1. A water-conducting household appliance, comprising:

a compartment having a closable compartment opening;

at least one washing device for generating at least one water jet in the compartment, and at least one baffle plate disposed on an inner side of the compartment in at least one area of impact of the water jet so that the baffle plate does not vibrate when impacted by the water jet, and a spring damper system that connects the baffle to compartment.

2. The water-conducting household appliance of claim 1, constructed in the form of a dishwasher.

3. The water-conducting household appliance of claim 1, wherein the baffle plate is constructed for noise damping and/or sound insulation.

4. The water-conducting household appliance of claim 1, further comprising a spring damper system to realize a disposition of the at least one baffle plate in a vibration-free manner.

5. The water-conducting household appliance of claim 4, wherein the spring damper system includes an intermediate piece made of a vibration-decoupling and/or vibration-damping material.

6. The water-conducting household appliance of claim 1, wherein the baffle plate is disposed on at least one member of the compartment selected from the group consisting of a side wall, a roof, and floor.

7. The water-conducting household appliance of claim 1, further comprising a plurality of said at least one baffle plate for disposition on at least one member of the compartment selected from the group consisting of a side wall, a roof, and floor.

8. The water-conducting household appliance of claim 1, further comprising a plurality of water jets and a plurality of baffle plates, wherein the baffle plates extend over an entire area that the water jets impact.

9. The water-conducting household appliance of claim 1, wherein the baffle plate is made of a material with a damping property higher than a damping property of a material used to form the compartment.

10. The water-conducting household appliance of claim 1, wherein the spring damper system comprises an intermediate piece made of a vibration-decoupling and/or vibration-damping material.

11. The water-conducting household appliance of claim 1, wherein the baffle plate comprises a surface structure adapted to insulate and/or dampen sound.

12. The water-conducting household appliance of claim 11, wherein the surface structure comprises ribs.

13. The water-conducting household appliance of claim 11, wherein the surface structure is adapted such that the water jet strikes the surface structure at an angle less than 90°.

14. The water-conducting household appliance of claim 11, wherein the surface structure is adapted such that the water jet strikes the surface structure at an angle less than 90°.

15. The water-conducting household appliance of claim 1, further comprising a plurality of said at least one baffle plate disposed on at least one member of the compartment selected from the group consisting of a side wall, a roof, and floor.

* * * * *